US005251371A

United States Patent [19]

Powers

[11] Patent Number: 5,251,371

[45] Date of Patent: Oct. 12, 1993

[54] T-LOCK SHINGLE ATTACHMENT FOR PNEUMATIC NAILERS

[76] Inventor: Jack D. Powers, 434 Valley High Cir. #B1, Colorado Springs, Colo. 80910

[21] Appl. No.: 963,463

[22] Filed: Oct. 20, 1992

[51] Int. Cl.[5] ..... B25C 1/04

[52] U.S. Cl. ..... 29/524; 227/156

[58] Field of Search ..... 227/130, 156, 8, 63; 29/521, 524; 52/526, 539

[56] References Cited

U.S. PATENT DOCUMENTS

| | | | |
|---|---|---|---|
| 2,194,659 | 3/1940 | Howle, Sr. | 52/526 |
| 2,675,989 | 4/1954 | Vogel | 227/63 |
| 3,301,992 | 1/1967 | Seeloff | 29/524 |
| 3,774,833 | 11/1973 | Deshich | 227/156 |
| 3,796,365 | 3/1974 | Downing | 227/8 |
| 4,627,563 | 12/1986 | Meyer | 227/156 |
| 4,856,696 | 8/1989 | Seld | 227/8 |

*Primary Examiner*—Scott Smith
*Attorney, Agent, or Firm*—William E. Hein

[57] ABSTRACT

A conventional pneumatic nailer commonly used in the construction trades includes a forwardly protruding horizontal T-lock spoon member attached to a nail discharge shoe of the pneumatic nailer to enable a roofer to lock T-shaped tabs of a conventional T-lock shingle into place on an adjacent shingle preparatory to nailing the T-lock shingle, using the pneumatic nailer.

1 Claim, 2 Drawing Sheets

T-LOCK SHINGLE ATTACHMENT FOR PNEUMATIC NAILERS

BACKGROUND AND SUMMARY OF THE INVENTION

This invention relates generally to pneumatic nailers of the type commonly used in the construction trades and more particularly to an attachment for such a nailer that permits its use when nailing T-lock shingles.

In the prior art, conventional asphalt composition shingles have been installed by hand because of the need to lock standard T-shaped tabs provided at the bottom of such shingles into place on the shingle adjacent the one being installed before nailing can take place. Therefore, each of these shingles is manually nailed into place by the installer following locking of the T-shaped tabs into the notches provided on the adjacent shingle. It is common practice for installers to use a conventional roofing hatchet to accomplish both the locking and nailing operations. Manual locking and nailing of these T-lock type shingles is time consuming compared to installation of conventional three-tab shingles that do not require a locking operation and that can therefore be installed using a conventional pneumatic nailing gun.

It is therefore a principal object of the present invention to provide an attachment for a conventional pneumatic nailer that permits the nailer to be used to lock the T-shaped tabs of a conventional T-lock composition shingle into place and to then perform a nailing operation on the shingle.

DETAILED DESCRIPTION OF THE INVENTION

Figure 1:
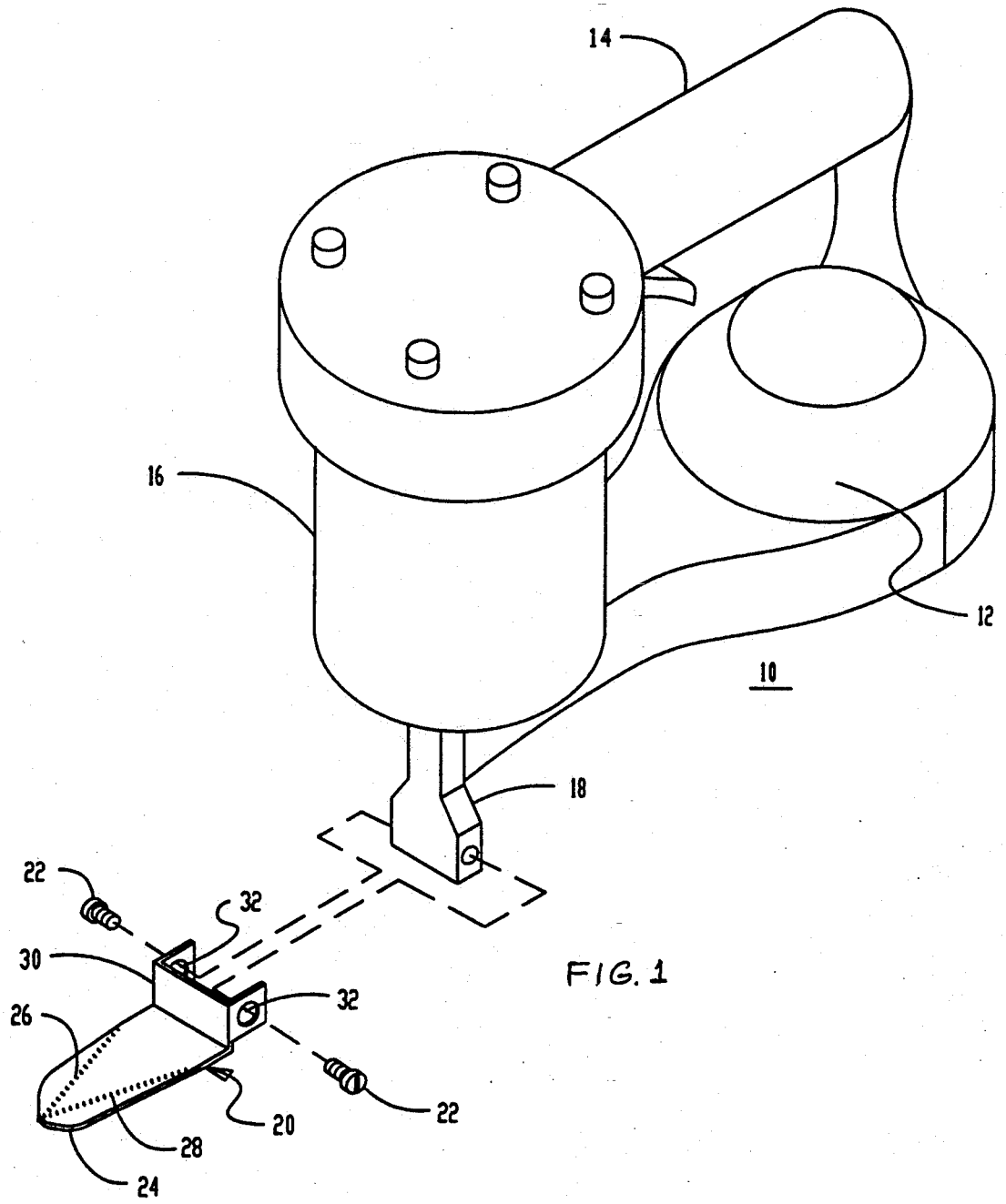
FIG. 1 illustrates how the T-lock shingle attachment of the present invention is connected to a conventional pneumatic nailer.
Figure 2A:
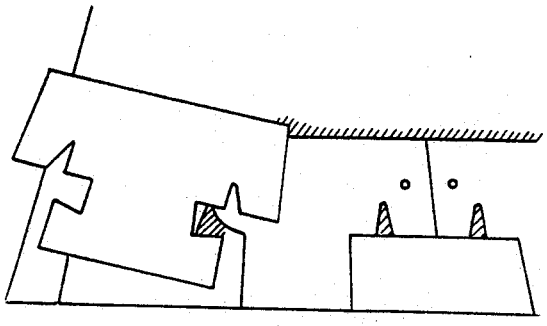
FIGS. 2A and 2B illustrate the way in which a first tab of a conventional T-lock shingle is slid under a previously applied shingle using the pneumatic nailer T-lock spoon attachment of the present invention.
Figure 2B:
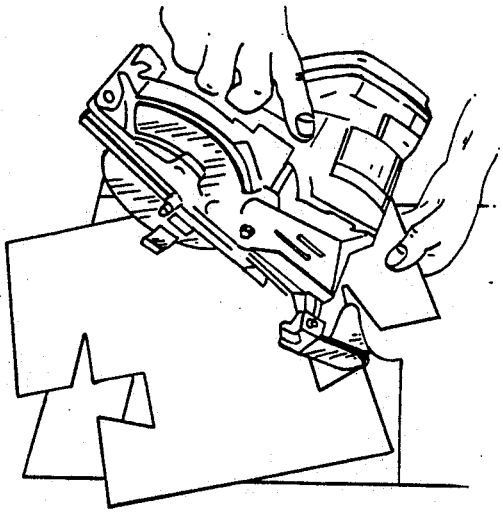
Figure 2C:
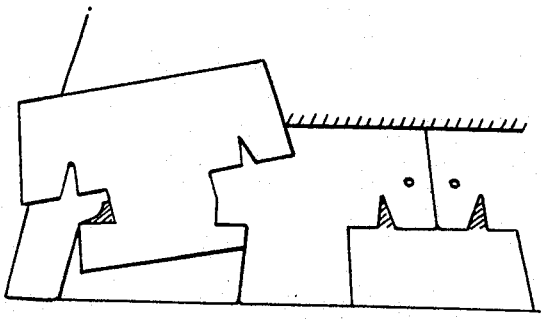
FIGS.2C and 2D illustrate the way in which a second tab of the T-lock shingle of FIGS. 2A and 2B is slid under a previously applied shingle using the pneumatic nailer T-lock spoon attachment of the present invention.
Figure 2D:
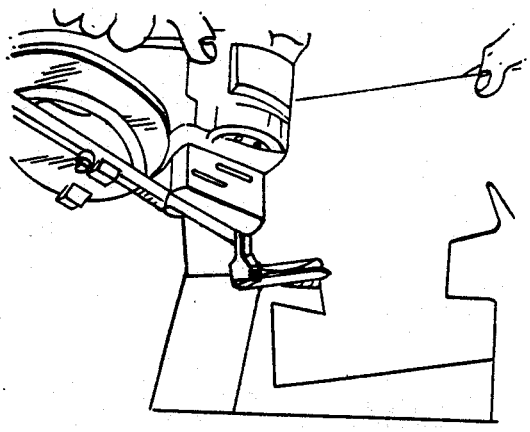
Figure 2E:
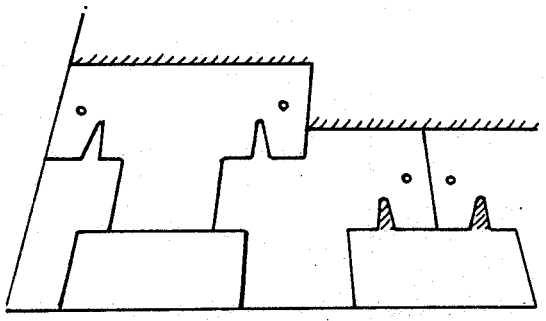
FIG. 2E and 2F illustrate the way in which the T-lock shingle of FIGS. 2A-D that has been previously locked using the pneumatic nailer T-lock spoon attachment of the present invention is finally nailed in place using a pneumatic nailer.
Figure 2F:
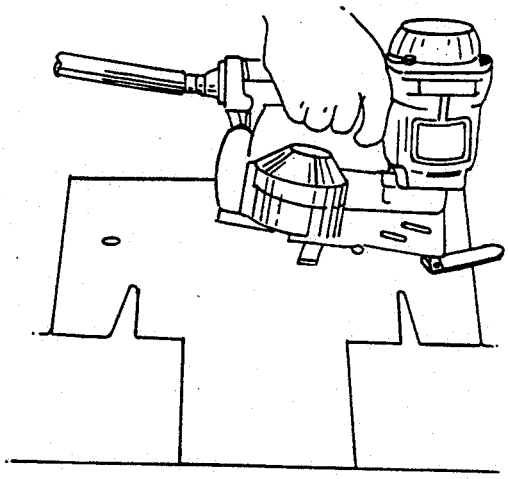

Referring to FIG. 1 there is shown a conventional pneumatic nailer 10 of the type commonly used in the construction trades. Exemplary of pneumatic nailer 10 is the N12B series coil-fed pneumatic nailer manufactured and sold by Bostitch. Pneumatic nailer 10 includes a nail magazine 12, a handle 14, a nailer body 16, and a nail discharge shoe 18. A T-lock spoon 20 is provided for attachment to nail discharge shoe 18 by way of two allen bolts 22, as illustrated. T-lock spoon includes a forwardly protruding portion 24 that is generally concave in shape. This concave shape is achieved by way of two upward bends along lines 26, 28. Rearward of portion 24, T-lock spoon 20 includes a rearwardly facing U-shaped connection member 30 containing a pair of holes 32 through which allen bolts 22 pass to attach T-lock spoon 20 to nail discharge shoe 18 of pneumatic nailer 10. T-lock spoon 20 may be fabricated of any of a number of commercially available steel, aluminum or plastic materials. For example, it may be punched out of a sheet of cold rolled steel using conventional fabrication techniques.

Referring to FIGS. 2A-F, it may be seen that a roofer employing pneumatic nailer 10 with T-lock spoon 20 attached thereto first uses the forwardly protruding portion 24 of T-lock spoon 20 to lock the T-shaped tabs of a conventional T-lock shingle in place on an adjacent shingle and then uses the pneumatic nailer 10 in a conventional way to nail the shingle onto the sub-roof. In actual practice, it has been found that the use of pneumatic nailer 10 with T-lock spoon 20 attached thereto results in increasing a roofer's productivity by at least 30% over the prior art manual technique in which a roofing hatchet is employed.

I claim:

1. A method for positioning and nailing a T-lock shingle in place, the method comprising:

providing a forwardly protruding horizontal T-lock spoon member attached to a nail discharge shoe of a pneumatic nailer;

locking T-shaped tabs of the T-lock shingle into lace on an adjacent T-lock shingle using said forwardly protruding horizontal T-lock spoon member; and nailing the T-lock shingle using the pneumatic nailer.

* * * * *